US006568917B2

(12) United States Patent
Fujii et al.

(10) Patent No.: US 6,568,917 B2
(45) Date of Patent: May 27, 2003

(54) RECIPROCATING COMPRESSOR AND METHOD OF LUBRICATING THE RECIPROCATING COMPRESSOR

(75) Inventors: Toshiro Fujii, Kariya (JP); Yoshiyuki Nakane, Kariya (JP); Susumu Tarao, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/913,032

(22) PCT Filed: Dec. 4, 2000

(86) PCT No.: PCT/JP00/08589

§ 371 (c)(1),
(2), (4) Date: Aug. 8, 2001

(87) PCT Pub. No.: WO01/42657

PCT Pub. Date: Jun. 14, 2001

(65) Prior Publication Data

US 2002/0127117 A1 Sep. 12, 2002

(30) Foreign Application Priority Data

Aug. 12, 1999 (JP) ..... 11-349276

(51) Int. Cl.[7] ..... F04B 27/08

(52) U.S. Cl. ..... 417/269; 417/313; 92/71; 91/499

(58) Field of Search ..... 417/269, 313; 92/71; 981/499; 184/6.17

(56) References Cited

U.S. PATENT DOCUMENTS

| | | | | |
|---|---|---|---|---|
| 5,722,817 A | | 3/1998 | Park et al. | 417/312 |
| 5,816,134 A | | 10/1998 | Takenaka et al. | 92/154 |
| 6,123,513 A | | 9/2000 | Hiramatsu et al. | 417/222.2 |
| 6,129,532 A | | 10/2000 | Kato et al. | 417/55.6 |
| 6,422,129 B1 | * | 7/2002 | Yokomachi et al. | 417/269 |

FOREIGN PATENT DOCUMENTS

| | | | | |
|---|---|---|---|---|
| DE | 296 23 653 U1 | | 4/1999 | F04B/53/14 |
| DE | 199 07 492 A1 | | 8/1999 | F04B/37/10 |
| EP | 0 780 572 A2 | | 6/1997 | F04B/1/12 |
| EP | 0 819 850 A2 | | 1/1998 | F04B/27/08 |
| FR | 2752270 | | 2/1998 | F04B/53/14 |
| JP | 9-119372 | | 6/1997 | F04B/17/04 |
| JP | 10-141227 | | 5/1998 | F04B/39/00 |
| JP | 10-504872 | | 5/1998 | F04B/35/04 |
| JP | 11-241682 | | 9/1999 | F04B/39/02 |
| JP | 11-257223 | | 9/1999 | F04B/35/04 |
| WO | WO 97/01033 | * | 1/1997 | |

* cited by examiner

*Primary Examiner*—Charles G. Freay
*Assistant Examiner*—Emmanuel Sayoc
(74) *Attorney, Agent, or Firm*—Morgan & Finnegan, LLP

(57) ABSTRACT

In a reciprocating compressor, an adequate lubricating effect is ensured for a sliding surface between a piston and a cylinder bore, and the leakage of a refrigerant for discharge is prevented.

After a lubricating oil mixed within the refrigerant is separated by an oil separator 23 on a discharge side, the separated lubricating oil is guided via an oil supply hole 29 in a cylinder block 1 to the sliding surface between the cylinder bore 12 and the piston 13 that reciprocates within the cylinder bore 12 thereof in order to lubricate the surface. In this reciprocating compressor, the intermediate axial portion of the outer circumference of the piston 13 has a small diameter in order to define an oil sump 30. The oil sump 30 is configured so as not to directly communicate with a drive chamber 7, and oil always collects within the oil sump 30.

9 Claims, 3 Drawing Sheets

RECIPROCATING COMPRESSOR AND METHOD OF LUBRICATING THE RECIPROCATING COMPRESSOR

TECHNICAL FIELD

The invention relates to a reciprocating compressor in which a piston reciprocates within a cylinder bore and specifically relates to a technique for lubricating the sliding surface between the cylinder bore and the piston.

PRIOR ART

In reciprocating compressors, an oil separator is provided on the downstream side of a discharge chamber, and after a refrigerant gas is separated from a lubricating oil by the oil separator, the lubricating oil is directed to and lubricates a sliding surface between a piston and a cylinder bore due to the pressure differential between the suction and discharge sides and is then returned to a drive chamber on the low-pressure side.

In order to improve the effect of lubricating the sliding surface between the piston and cylinder bore, the compressor has an oil groove extending axially toward the outer circumference of the piston. In a known configuration, the lubricating oil is supplied from an oil hole and is guided to the sliding surface via the oil groove, which actively communicates with the drive chamber. This lubricating technique is disclosed, for example, in Japanese Laid-open Patent Publication No. 10-141227.

However, in systems in which the lubricating oil is separated from the refrigerant gas at the sliding surface between the piston and the cylinder bore due to the pressure differential between the suction and discharge sides, the use of a configuration comprising the oil groove on the outer circumference of the piston creates the problems of leakage of the refrigerant into the drive chamber via the oil groove and a decrease in performance due to the active communication of the oil groove with the drive chamber. This phenomenon is particularly problematic in compressors that employ carbon dioxide ($CO_2$) as a refrigerant due to the large pressure differential between the suction and discharge pressures.

The invention has been designed with due consideration given to these conventional problems and has objectives to facilitate an adequate lubricating effect for the sliding surface between the piston and the cylinder bore of a reciprocating compressor and to prevent leakage of the refrigerant.

DISCLOSURE OF THE INVENTION

In order to attain the above objectives according to the invention, an oil sump is provided on the sliding surface between the piston and the cylinder bore in a reciprocating compressor. As a result, the lubricating oil collects in the oil sump, the lubricating oil ensures an adequate lubricating effect for the sliding surface, and seizure is prevented. Moreover, a configuration is taught in which the oil sump does not communicate with the drive chamber, which is situated on the low-pressure side, so that connection essentially occurs only via the gap between the piston and the cylinder bore. This enables the amount of refrigerant that leaks toward the drive chamber side to be reduced and prevents a drop in performance.

Consequently, lubricating oil directed toward the oil sump is preferably a lubricating oil separated from the refrigerant for discharge, and a configuration in which the lubricating oil is directed due to the pressure differential between the suction and discharge sides is preferable. This construction is particularly effective to reduce the amount of leaking refrigerant when utilized with a compressor that uses carbon dioxide as the refrigerant.

It is also preferable to locate the oil sump around the entire circumference of the sliding surface. In this case, the entire circumference of the sliding surface is sealed and the lubricating oil collects in the oil sump, which further reduces the amount of refrigerant that leaks toward the drive chamber.

It is also preferable to dispose the oil sump on the outer circumference of the piston. For this configuration, the intermediate axial portion of the outer circumference of the piston preferably has a small diameter. By disposing the oil sump on the piston, the oil sump can be manufactured using the most commonly known outer circumference processing methods in machine tooling and as a result, the associated processing is easily performed.

EMBODIMENT OF THE INVENTION

Figure 1:
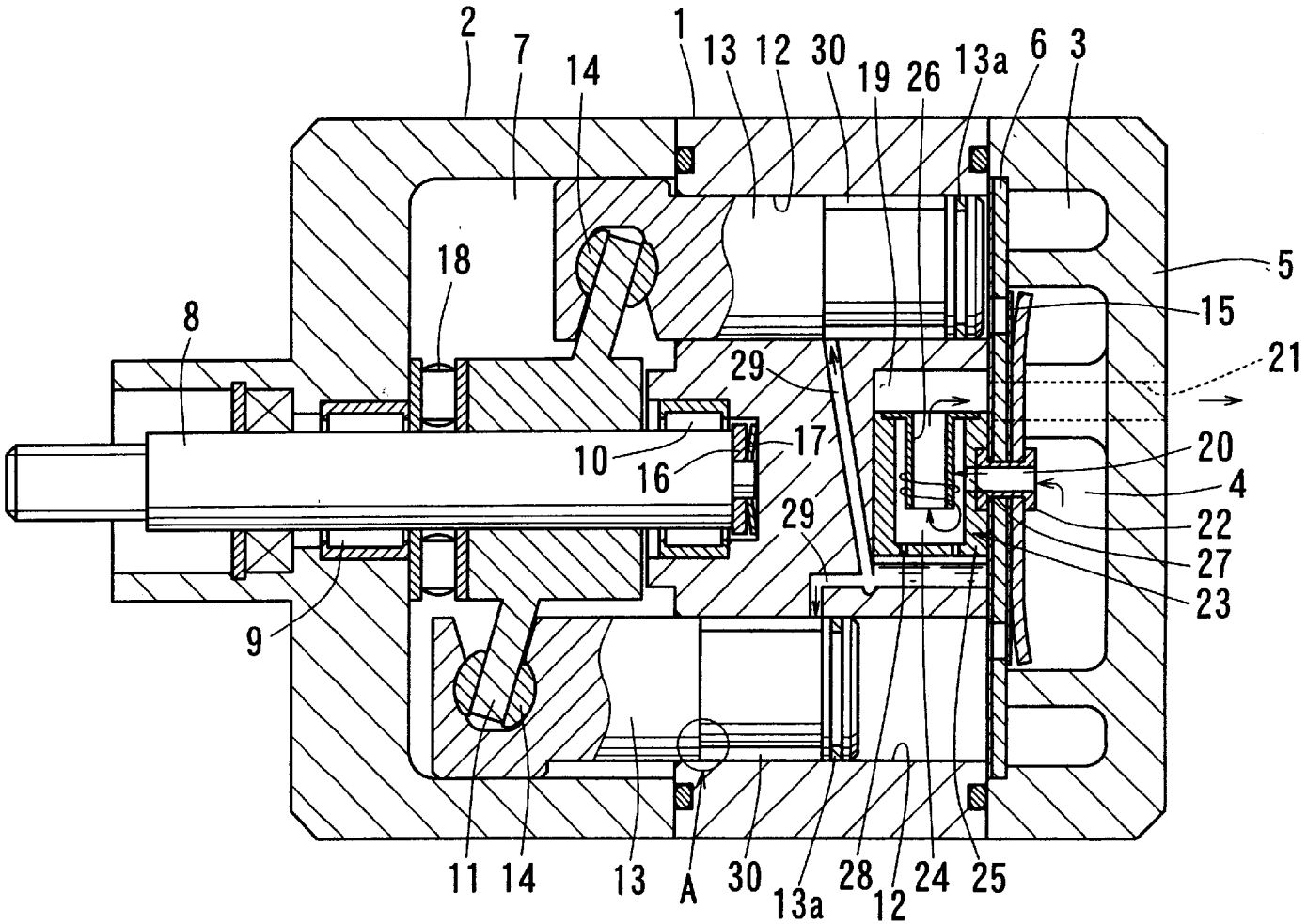
FIG. 1 is a cross section showing the reciprocating compressor of the following embodiment.

Hereinafter, an embodiment of the invention shall be described with reference to the drawings. This embodiment, as is shown in FIG. 1, is an application for a cam-plate-type reciprocating compressor. A front housing 2 is joined to the front end of a cylinder block 1, thereby forming part of the outer edge of the compressor, and a rear housing 5 defining a suction chamber 3 and a discharge chamber 4 is joined to the rear end thereof via a valve plate 6.

A drive shaft 8 is connected to a source of power and penetrates through a drive chamber 7 formed in the front housing 2, and the drive shaft 8 is rotatably supported by the cylinder block 1 and the front housing 2 via radial bearings 9 and 10. A rotational cam plate 11 is contained within the drive chamber 7 and the rotational cam plate 11 is anchored to the drive shaft 8.

The cylinder block 1 comprises a plurality of cylinder bores 12 penetratingly and circumferentially disposed and regularly spaced, and pistons 13 are slidably disposed within the cylinder bores 12. The base ends of the pistons 13 extend into the drive chamber 7 and are coupled to the rotational cam plate 11 via a shoe 14.

Therefore, when the drive shaft 8 is rotated, the rotational movement thereof is converted into linear reciprocating movement of the pistons 13 by the rotational cam plate 11 and the shoe 14. Due to the reciprocating movement of the pistons 13 within the cylinder bores 12, a refrigerant in the suction chamber 3 is drawn into the cylinder bores 12 via a suction valve (not shown) and then, while being compressed, is discharged toward the discharge chamber 4 via a discharge valve 15. The upper half of FIG. 1 shows one of the pistons 13 at its top dead point and the lower half of the drawing shows another one of the pistons 13 at its bottom dead point.

The radial bearing 10 is disposed within a circular hole that is provided in the central portion of the cylinder block 1. A thrust race 16 and a plate spring 17, which urges the rear portion of the drive shaft 8 forward, are disposed on the bottom of the hole. The urging force of the plate spring is supported by a thrust bearing 18 disposed between the rotational cam plate 11 and the front housing 2.

A chamber 19 is hollowed out in the central portion of the cylinder block 1 and opposes the valve plate 6. The chamber 19 is communicated with the discharge chamber 4 by a first discharge pathway 20 near the mid-section in the vertical direction and communicates with an external circuit, which is a refrigeration circuit, via a second discharge pathway 21 on the upper side. A fixture 22 for affixing the discharge valve 15 to the valve plate 6 is penetratingly located in the first discharge pathway 20.

A centrifugal-separation-type oil separator 23 for separating the lubricating oil from a highly pressurized refrigerant gas sent through the chamber 19 to the refrigeration circuit is provided within the chamber 19. The oil separator 23 comprises a base 25 with a separation chamber 24 having a bottomed, circular hole shape and a gas duct with a flange 26 attached to the base 25 so as to hang concentrically from the edge of the upper opening of the separation chamber 24. The separation chamber 24 communicates with the first discharge pathway 20 via a hole 27 that penetrates a side wall of the base 25. The hole 27 opens almost tangentially to the inside of the separation chamber 24.

Therefore, the lubricating oil is introduced into the separation chamber 24 with the refrigerant so that it travels from the first discharge pathway 20 through the hole 27 to rotate along the periphery of the gas duct 26, the lubricating oil then collides against the circumferential wall of the separation chamber 24 due to centrifugal force, separates from the refrigerant and flows downward, passes through a penetrating hole 28 located in the bottom wall of the oil separation chamber 24, and collects at the bottom of the chamber 19.

The refrigerant for discharge that is separated from the lubricating oil, on the other hand, is sent to the refrigeration circuit from the gas duct 26 via the second discharge pathway 21.

An oil supply hole 29 is provided in the cylinder block 1 in order to guide the lubricating oil that has collected in the chamber 19 to the sliding surface between the pistons 13 and the cylinder bores 12. The oil supply hole 29, on one end, is communicated with the bottom surface of the chamber 19, and on the other end, with an oil sump 30 disposed on the sliding surface between the pistons 13 and the cylinder bores 12.

In this embodiment, the oil sump 30 is formed by providing a small-diameter portion on the intermediate axial portion of the outer circumference of the pistons 13. In other words, by utilizing on the piston 13 a portion having a diameter less than the outer diameters of the head of the piston 13 opposing the cylinder bores and the base of the piston 13 facing the drive chamber 7, a ring-shaped oil sump 30 is defined.

Figure 2:
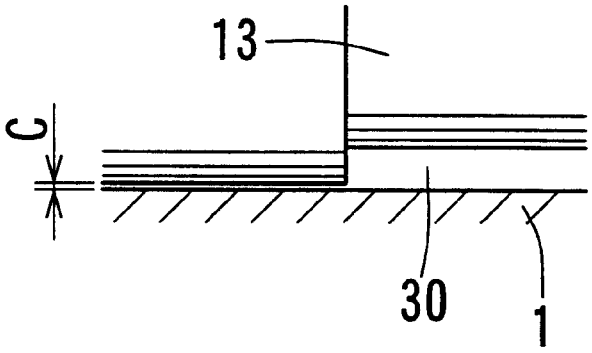
FIG. 2 is an expanded view of Area A in FIG. 1.

The oil sump 30, as is shown in FIG. 1, always communicates via the oil supply hole 29 with the chamber 19, which is on the discharge side, but does not communicate with the drive chamber 7 on the low-pressure side during the entire stroke of the reciprocating pistons 13. In other words, each oil sump 30 communicates with the oil supply hole 29 at the base and head ends of the pistons 13 even when the pistons 13 are located at the top or bottom dead points while not communicating with the drive chamber 7 even when the pistons 13 are located at the bottom dead point. Each oil sump 30, as shown in FIG. 2, is configured so as to communicate with the drive chamber 7 via the smallest clearance C (hereinafter referred to as a "side clearance") that is necessary to ensure the proper sliding action of the pistons 13 against the cylinder bores 12. The head of each piston 13 includes a piston spring 13*a*.

In the compressor of this embodiment, which is configured in the manner discussed above, when the pistons 13, which are coupled to the rotational cam plate 11 that rotates in conjunction with the drive shaft 8, reciprocate linearly within the cylinder bores 12 and compression begins, the compressed refrigerant gas pushes open the discharge valve 15, is discharged into the discharge chamber 4, and is then introduced into the chamber 19 from the first discharge pathway 20. The lubricating oil in the refrigerant gas introduced into the chamber 19 in conjunction with rotation is separated from the refrigerant gas due to centrifugal force, flows down the wall surface of the separation chamber 24 under its own weight, and from the penetrating hole 28 collects at the bottom of the chamber 19.

In this manner, the lubricating oil separated from the refrigerant gas that collects at the bottom of the chamber 19 is sent through the oil supply hole 29 to and collects in the oil sumps 30 on the outer circumferences of the pistons 13. The lubricating oil is supplied to the sliding surface by the reciprocating motion of the pistons 13 in order to lubricate the sliding surface. Therefore, the sliding surface is reliably lubricated and seizure is prevented.

The oil sumps 30 do not directly communicate with the drive chamber 7, which is located on the low-pressure side, but rather communicate via the side clearances C, so that a sealing effect due to the lubricating oil collecting in the oil sumps 30 is attained, and leakage of the refrigerant gas from the side clearances C is prevented. As a result, the amount of refrigerant that leaks to the drive chamber 7 is reduced. In this embodiment, the oil sumps 30 are located around the entire circumference of the sliding surfaces, so that a drop in performance attributable to the leakage of the refrigerant is prevented.

This design is even more effective when utilized with a compressor that guides the oil under extremely high pressure, such as a compressor that employs carbon dioxide ($CO_2$) as the refrigerant.

In this embodiment as well, a small diameter portion formed in the intermediate axial portion of the outer circumferences of the pistons 13 defines a ring-like oil sump 30, so that the oil sump 30 can be processed using the most commonly utilized outer circumference cutting methods in machine tooling, whereby the associated production is easily performed. By providing the oil sumps 30 in this embodiment, the area of the sliding surface between the pistons 13 and the cylinder bores 12 can be reduced, so that sliding resistance is reduced, and loss of power is decreased.

Figure 3:
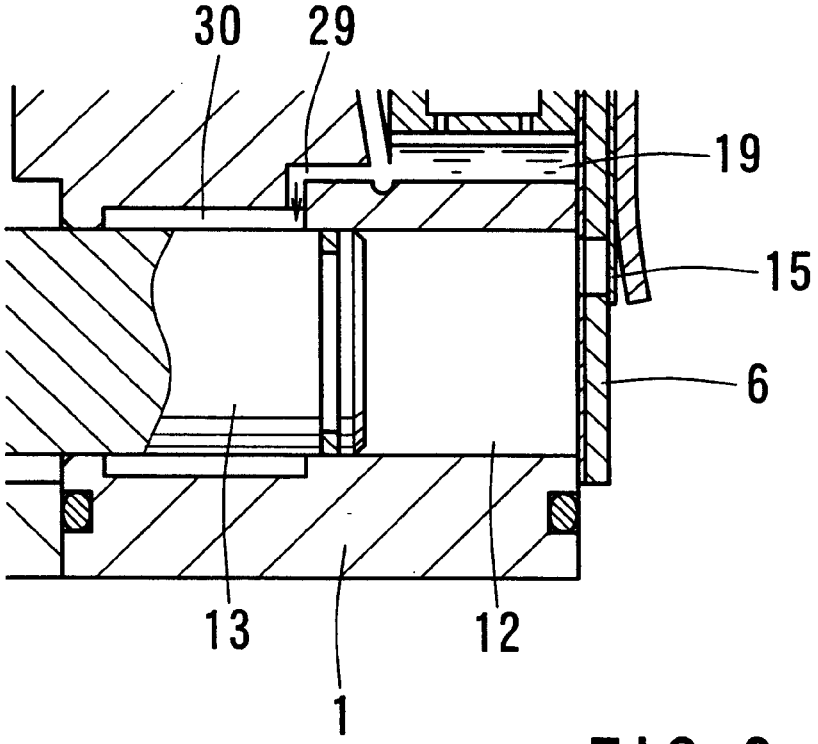
FIG. 3 is a descriptive diagram showing a modified example of the oil sump.

The invention is not limited to the above embodiment and may be appropriately modified within a range that does not diverge from its fundamental nature. For example, although the oil sumps 30 were defined by providing a small diameter portion on the outer circumference of the pistons 13, the oil sumps 30 can also be defined by forming a ring-like recess on the inner surface of the cylinder bores 12 as shown in FIG. 3. In the alternative, the oil sumps 30 can be defined on both the pistons 13 and the cylinder bores 12.

Figure 4:
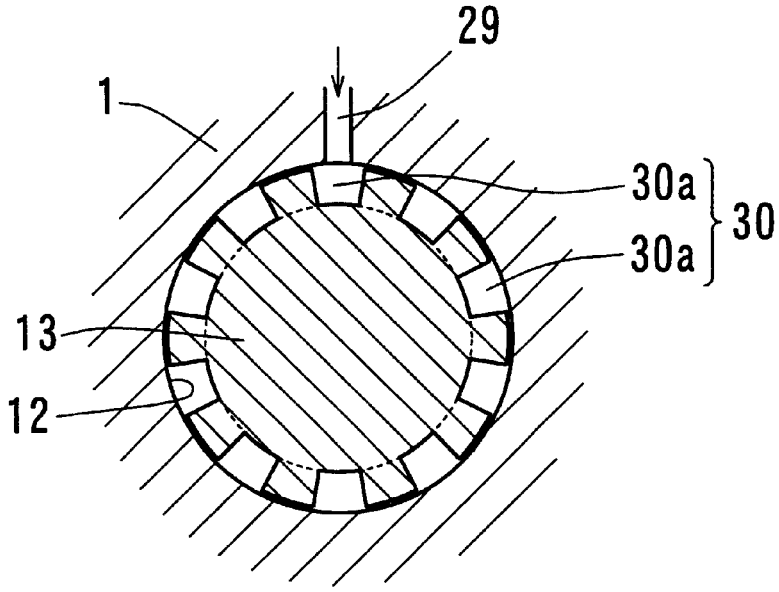
FIG. 4 is a descriptive diagram showing another modified example of the oil sump.
Figure 5:
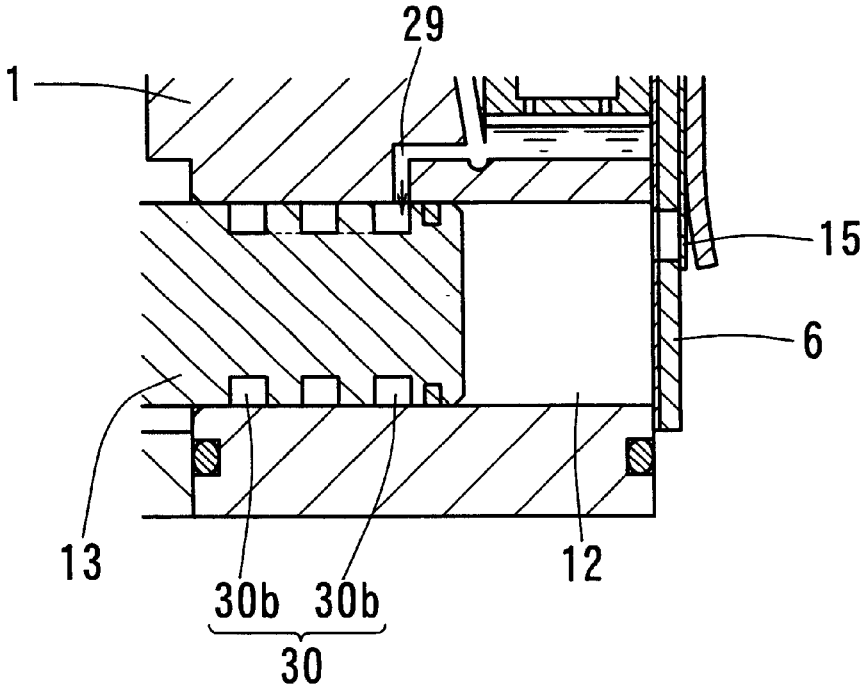
FIG. 5 is a descriptive diagram showing yet another modified example of the oil sump.

The shape of the oil sumps 30 is not required to be limited to a ring-like shape. As shown in FIG. 4, for example, the shape can be modified to a substantially spline configuration with a plurality of axially extending, linear grooves 30*a* that are circumferentially disposed. In the alternative, a plurality of ring-like grooves 30*b* can be axially formed in parallel to each other on the outer circumference of each piston 13, as shown in FIG. 5. The linear grooves 30*a* and the ring-like grooves 30*b* in the configurations shown in FIGS. 4 and 5 must be mutually communicated by a connecting pathway to neighboring grooves.

Furthermore, the oil sumps 30 are not required to be defined around the entire circumference and may instead cover only a portion of the circumference. It goes without saying that these techniques can also be applied to a non-cam-plate-type compressor, as long as it is a reciprocating compressor. Moreover, the oil separator 23 is not limited to one that uses a centrifugal separation method as the use of another separation technique would not hinder the invention.

Industrial Applicability

As has been discussed above, the invention ensures reliable lubrication for the sliding surface between the pistons and cylinder bores, prevents burning, and prevents a drop in performance attributable to leakage of the refrigerant for discharge from the sliding surface.

What is claimed is:

1. A reciprocating compressor comprising a cylinder bore and a piston that reciprocates within the cylinder bore and guides a lubricating oil to a sliding surface between the cylinder bore and the piston in order to lubricate the sliding surface, wherein an oil sump is defined on the sliding surface at which the lubricating oil collects and does not communicate with a drive chamber to which a base of the piston faces, and wherein the lubricating oil is guided to the oil sump due to a pressure difference between a suction side and a discharge side.

2. A reciprocating compressor comprising a cylinder bore and a piston that reciprocates within the cylinder bore and guides a lubricating oil to a sliding surface between the cylinder bore and the piston in order to lubricate the sliding surface, wherein an oil sump is defined on the sliding surface at which the lubricating oil collects and does not communicate with a drive chamber to which a base of the piston faces, and wherein the lubricating oil is separated from a refrigerant and is guided to the oil sump due to a pressure difference between a suction side and a discharge side.

3. The reciprocating compressor according to claim 2, wherein the refrigerant is carbon dioxide.

4. The reciprocating compressor according to claim 1, wherein the oil sump is defined around the entire circumference of the sliding surface.

5. The reciprocating compressor according to claim 1, wherein the oil sump is defined on the outer circumference of the piston.

6. The reciprocating compressor according to claim 5, wherein the oil sump is defined on an intermediate axial portion of the outer circumference of the piston that is formed to have a small diameter.

7. A reciprocating compressor comprising a cylinder bore and a piston that compresses a refrigerant drawn from a suction chamber due to reciprocating movement of the piston within the cylinder bore and discharges the refrigerant to a discharge chamber, wherein the piston guides a lubricating oil, which is separated from the refrigerant gas after discharge, to a sliding surface between the cylinder bore and the piston due to a pressure differential between a suction side and a discharge side, the reciprocating compressor further comprising an oil sump defined on the sliding surface, wherein the oil sump is defined at an intermediate axial zone on the outer circumference of the piston having a diameter that is smaller than both opposing sides of the intermediate axial zone, wherein the oil sump always communicates with the discharge side, which is the supply side of the lubricating oil, during the entire stroke of the reciprocating piston, and the oil sump does not communicate with a drive chamber that is the outflow side of the lubricating oil, the drive chamber accommodating a cam plate for driving the piston.

8. A method for lubricating a reciprocating compressor that comprises a cylinder bore and a piston that reciprocates within the cylinder bore that guides a lubricating oil to a sliding surface between the cylinder bore and the piston in order to lubricate the sliding surface, the method comprising guiding the lubricating oil to an oil sump defined on the sliding surface due to a pressure difference between a suction side and a discharge side, collecting the lubricating oil in the oil sump, and supplying the lubricating oil from the oil sump to the sliding surface without causing the oil sump to communicate with a drive chamber to which a base of the piston faces while reciprocating the piston.

9. A method for lubricating a reciprocating compressor that comprises a cylinder bore and a piston that reciprocates within the cylinder bore that guides a lubricating oil to a sliding surface between the cylinder bore and the piston in order to lubricate the sliding surface, the method comprising guiding the lubricating oil, which has been separated from a refrigerant, to an oil sump defined on the sliding surface due to a pressure difference between a suction side and a discharge side, collecting the lubrication oil in the oil sump and supplying the lubricating oil from the oil sump to the sliding surface without causing the oil sump to communicate with a drive chamber to which base of the piston faces while reciprocating the piston.

* * * * *

UNITED STATES PATENT AND TRADEMARK OFFICE

CERTIFICATE OF CORRECTION

PATENT NO. : 6,568,917 B2
DATED : May 27, 2003
INVENTOR(S) : Fujii et al.

It is certified that error appears in the above-identified patent and that said Letters Patent is hereby corrected as shown below:

Title page, Item [54] and Column 1, line 2,
Please change "METHOD OF LUBRICATING" to -- METHOD FOR LUBRICATING --.

Title page,
Item [30], Foreign Application Priority Data, please change "Aug. 12, 1999" to -- Dec. 8, 1999 --.

Signed and Sealed this

Twenty-eighth Day of October, 2003

JAMES E. ROGAN
*Director of the United States Patent and Trademark Office*